US007677233B2

(12) United States Patent
Bednar

(10) Patent No.: US 7,677,233 B2
(45) Date of Patent: Mar. 16, 2010

(54) CROSSBOW SUPPORT ROD

(75) Inventor: Richard L. Bednar, Monroe Falls, OH (US)

(73) Assignee: TenPoint Crossbow Technologies, Suffield, OH (US)

( * ) Notice: Subject to any disclaimer, the term of this patent is extended or adjusted under 35 U.S.C. 154(b) by 416 days.

(21) Appl. No.: 11/424,134

(22) Filed: Jun. 14, 2006

(65) Prior Publication Data

US 2007/0068501 A1 Mar. 29, 2007

Related U.S. Application Data

(60) Provisional application No. 60/690,434, filed on Jun. 14, 2005.

(51) Int. Cl.
*F41B 5/12* (2006.01)

(52) U.S. Cl. ..... 124/25; 124/86; 42/94

(58) Field of Classification Search ..... 124/23.1, 124/25, 86; 42/94
See application file for complete search history.

(56) References Cited

U.S. PATENT DOCUMENTS 1,750,803 A * 3/1930 Hayden ..... 248/125.9
4,206,740 A * 6/1980 Lydon ..... 124/25
5,194,678 A 3/1993 Kramer
5,345,706 A * 9/1994 Brown ..... 42/94
5,619,981 A * 4/1997 Breedlove ..... 124/89
5,641,147 A 6/1997 Pena
5,903,995 A 5/1999 Brubach
5,988,466 A 11/1999 Brown
6,027,087 A 2/2000 Lindemann et al.
6,070,569 A * 6/2000 Chalin et al. ..... 124/86
6,205,992 B1 * 3/2001 Meeks et al. ..... 124/86
6,843,015 B2 1/2005 Sharp

* cited by examiner

*Primary Examiner*—John Ricci
(74) *Attorney, Agent, or Firm*—Brouse McDowell; John M. Skeriotis

(57) ABSTRACT

A weapon, such as a crossbow or firearm, may have a main beam, a trigger mechanism mounted to the main beam and, a support rod that can be positioned into a first use position and a second stowed position. The support rod may have a first end used to support the main beam and a second end used to contact a ground surface. In one embodiment, a contact member with a hemispherical contact surface is attached to the second end of the support rod. In another embodiment, the support rod has a handgrip portion that receives a user's hand in supporting the weapon when shooting the weapon when the support rod is in the second stowed position. In still another embodiment, a mounting bracket is used to provide at least two locations for attaching the support rod to the main beam.

3 Claims, 7 Drawing Sheets

CROSSBOW SUPPORT ROD

This application claims priority to provisional patent application, U.S. Ser. No. 60/690,434, titled CROSSBOW POD SYSTEM, filed Jun. 14, 2005, which provisional application is incorporated herein by reference.

I. BACKGROUND OF THE INVENTION

A. Field of Invention

This invention relates to the art of methods and apparatus for support rods that support equipment during use and more specifically to methods and apparatus for support rods that support weapons such as firearms and crossbows.

B. Description of the Related Art

It is known in the art to provide various types of supports for firearms and crossbows. In general these supports are used to relieve the user from having to hold up the entire load of the weapon. Such supports are especially useful when the user needs to maintain the weapon in a "ready to shoot" position while waiting for game. Monopod, bipod and tripod designs are all known and used. While such known weapon supports may work well for their intended purpose, they have limitations and thus improvements would be well received by hunters and others who use weapons.

One desirable improvement would be a weapon support that can be used both to support the weapon against a user's body and against a tree stand or other such ground surface. Another desirable improvement would be a weapon support that can be held by the user for shooting the weapon while the support is in a stowed position. Still another desirable improvement would be a weapon support that can easily be adjusted to support the weapon at different locations and/or with different support components.

Examples of known weapon supports are provided in U.S. Pat. No. 5,194,678 (a support that attaches to the sling swivel of a rifle), U.S. Pat. No. 5,641,147 (a support head for a rifle monopod support), U.S. Pat. No. 5,903,995 (a monopod that permits a rifle to swivel), U.S. Pat. No. 5,988,466 (a rifle support that can be supported on the user's body), and U.S. Pat. No. 6,843,015 (a bipod that supports a rifle). None of these devices, however, provide the improvements noted above and discussed further below.

II. SUMMARY OF THE INVENTION

According to one embodiment of this invention, a crossbow includes: I. a main beam having a first portion and a second portion; II. a bow assembly mounted to the first portion of the main beam and adapted to propel an arrow, the bow assembly including: (a) a bow; and, (b) a bowstring attached to the bow; III. a trigger mechanism mounted to the second portion of the main beam; IV. a support rod that is selectively positionable into a first use position and a second stowed position, the support rod including: (a) a first end pivotally attached to the first portion of the main beam; (b) a second end having a contact member with a hemispherical contact surface that is adapted to (1) cushion the crossbow against a user's body when the support rod is in the first use position; and, (2) grip a ground surface when the support rod is in the first use position; and, (c) a handgrip portion adapted to receive a user's hand in supporting the crossbow for shooting the crossbow when the support rod is in the second stowed position; and, V. a securing mechanism that selectively secures the support rod to the main beam when the support rod is in the second stowed position.

According to another embodiment of this invention, a weapon includes: I. a main beam having a first portion and a second portion; II. a trigger mechanism mounted to the second portion of the main beam; and, III. a support rod that is selectively positionable into a first use position and a second stowed position, the support rod including: (a) a first end adapted to support the first portion of the main beam; and, (b) a second end having a contact member with a hemispherical contact surface that is adapted to (1) cushion the weapon against a user's body when the support rod is in the first use position; and, (2) grip a ground surface when the support rod is in the first use position.

According to another embodiment of this invention, a weapon includes: I. a main beam having a first portion and a second portion; II. a trigger mechanism mounted to the second portion of the main beam; and, III. a support rod that is selectively positionable into a first use position and a second stowed position, the support rod including: (a) a first end adapted to support the first portion of the main beam; (b) a second end having a contact surface adapted to contact a ground surface when the support rod is in the first use position; and, (c) a handgrip portion adapted to receive a user's hand in supporting the weapon for shooting the weapon when the support rod is in the second stowed position.

According to yet another embodiment of this invention, a weapon includes: I. a main beam having a first portion and a second portion; II. a trigger mechanism mounted to the second portion of the main beam; III. a mounting bracket attached to the first portion of the main beam and having first and second connection locations; and, IV. a support rod that is selectively positionable into a first use position and a second stowed position, the support rod including: (a) a first end adapted to support the first portion of the main beam at either the first or second connection locations; and, (b) a second end having a contact surface adapted to contact a ground surface when the support rod is in the first use position.

One advantage of this invention is that the support rod can be used both to support a weapon against a user's body and also used to support the weapon against a ground surface.

Another advantage of this invention is that the support rod can be held by the user for shooting the weapon while the support rod is in a stowed position.

Still another advantage of this invention is that the weapon support mechanism can be easily adjusted to support the weapon at different locations and/or with different support components.

Still other benefits and advantages of the invention will become apparent to those skilled in the art to which it pertains upon a reading and understanding of the following detailed specification.

III. BRIEF DESCRIPTION OF THE DRAWINGS

The invention may take physical form in certain parts and arrangement of parts, various embodiments of which will be described in this specification and illustrated in the accompanying drawings which form a part hereof and wherein.

IV. DEFINITIONS

The following definitions are controlling for the disclosed invention:

"Arrow" means a projectile that is shot with (or launched by) a bow assembly.

"Bipod" means a support device using two support rods.

"Bow" means a bent, curved, or arched object.

"Bow Assembly" means a weapon comprising a bow and a bowstring that shoots or propels arrows powered by the elasticity of the bow and the drawn bowstring.

"Bowstring" means a string or cable attached to a bow.

"Bullet" means a projectile that is fired from a fire arm.

"Carbide" means a hard material made of compacted binary compounds of carbon and heavy metals.

"Compound Bow" means a crossbow that has pulleys or cams at each end of the bow through which the bowstring passes.

"Crossbow" means a weapon comprising a bow assembly and a trigger mechanism both mounted to a main beam.

"Draw Weight" means the amount of force required to draw or pull the bowstring on a crossbow into a cocked condition.

"Elastomeric Material" means any substance having the elastic properties of natural rubber.

"Firearm" means a weapon comprising a trigger mechanism mounted to a main beam, including a pistol or rifle, which shoots or fires bullets.

"Ground Surface" means any solid surface upon which a weapon may be supported including a tree stand and the earth.

"Hemispherical" means a shape substantially like one half of a sphere.

"Main Beam" means the longitudinal structural member of a weapon used to support the trigger mechanism and often other components as well. For crossbows, the main beam also supports the bow assembly. The main beam often comprises a stock member, held by the person using the weapon, and a barrel, used to guide the projectile being shot or fired by the weapon.

"Monopod" means a support device using a single support rod.

"Spherical" means a shape substantially like a sphere.

"Trigger Mechanism" means the portion of a weapon that shoots, fires or releases the projectile of a weapon. As applied to crossbows, trigger mechanism means any device that holds the bowstring of a crossbow in the drawn or cocked condition and which can thereafter be operated to release the bowstring out of the drawn condition to shoot an arrow. As applied to firearms, trigger mechanism means any device capable of firing a bullet using an explosive charge as a propellant.

"Tripod" means a support device using three support rods.

"Weapon" means any device used in fighting or hunting that shoots or fires a projectile including firearms, bow assemblies and crossbows.

V. DETAILED DESCRIPTION OF THE INVENTION

Figure 1:
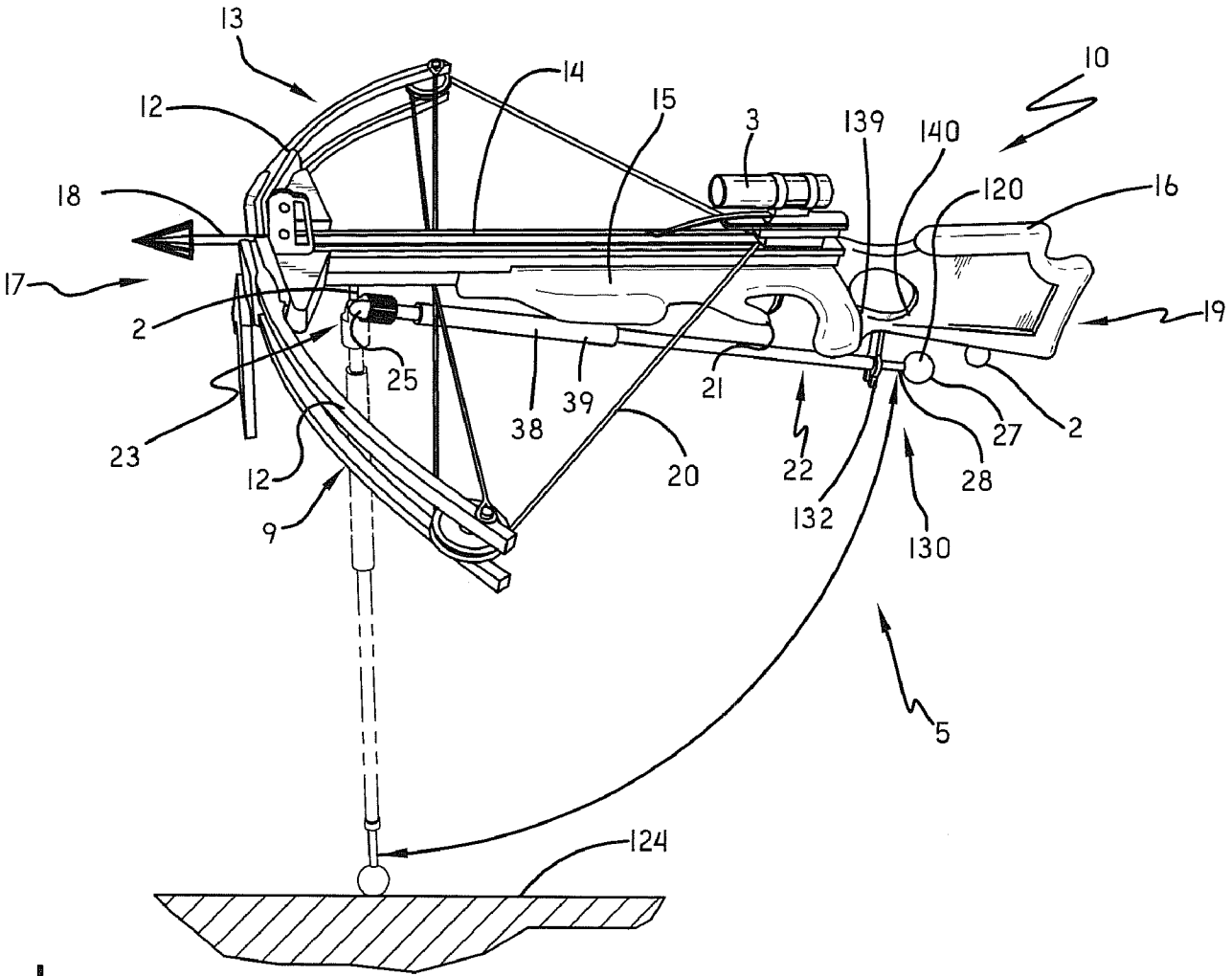
FIG. 1 is a perspective view of a crossbow equipped with a support rod according to certain embodiments of this invention.
Figure 2:
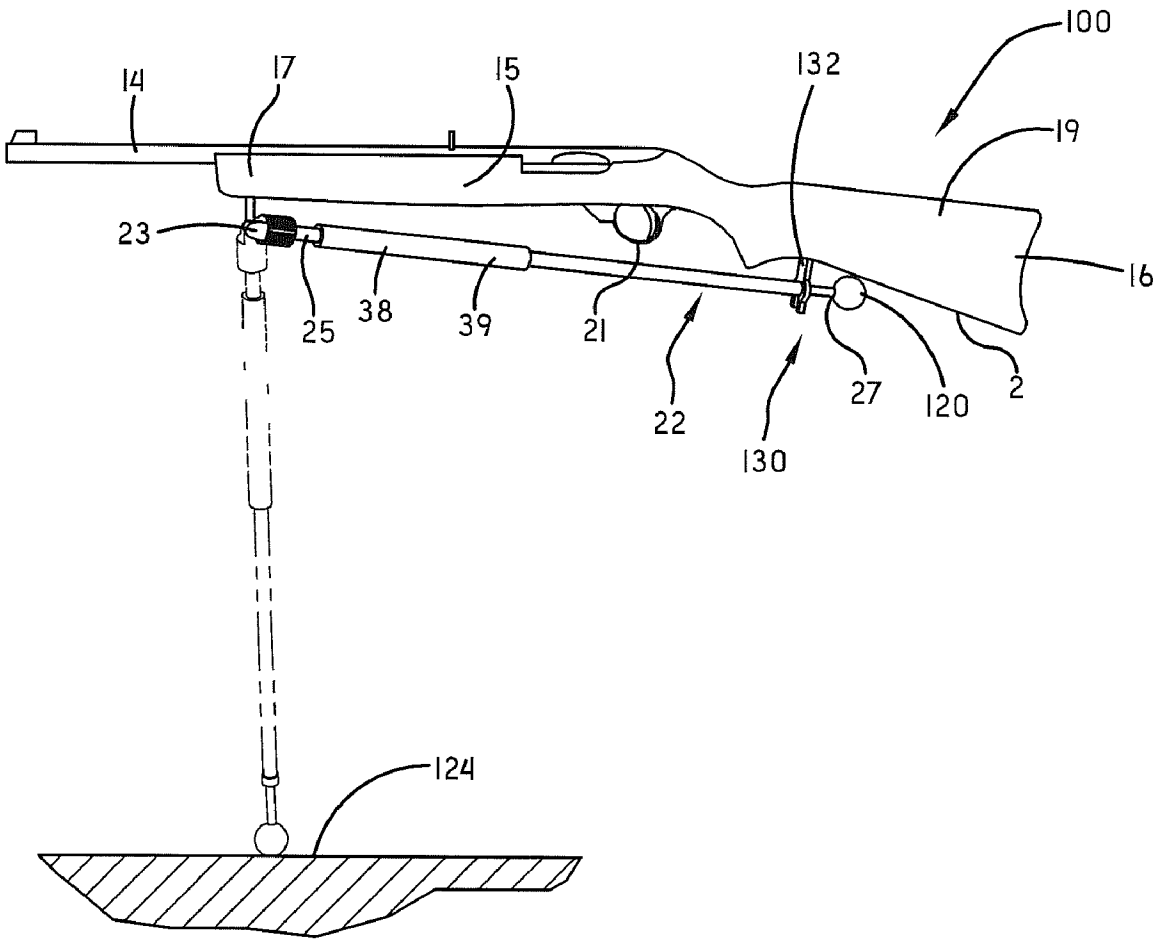
FIG. 2 is a perspective view of a firearm equipped with a support rod according to certain embodiments of this invention.

Referring now to the drawings wherein the showings are for purposes of illustrating embodiments of the invention only and not for purposes of limiting the same, FIGS. 1 and 2 each show a weapon 5 equipped with a support rod 22 according to certain embodiments of this invention. The weapon 5 shown in FIG. 1 is a crossbow 10, in particular a compound bow, and the weapon 5 shown in FIG. 2 is a firearm 100, in particular a rifle, though it should be understood that this invention will work with other types of weapons as well. Both the crossbow 10 and the firearm 100 have a main beam 15 with a stock member 16 and a barrel member 14. Each main beam 15 has a first portion 17 and a second portion 19. A trigger mechanism 21, suitable for shooting an arrow or bullet as required, is mounted to the second portion 19 of the main beam 15. A bow assembly 13 is mounted to the first portion 17 of the main beam 15 of the crossbow 10. The bow assembly 13 includes a bow 9 having a pair of limbs 12, 12 and a bowstring 20 attached to the limbs 12, 12. An arrow 18 is supported on the barrel member 14 in the ready to shoot position. Other weapon components well known to those of skill in the art, such as a scope 3 and one or more sling swivel studs 2 may be optionally used with the weapon 5 without departure from this invention. As the basic operation of crossbows and firearms are well known, details of their operation will not be described.

Figure 3:
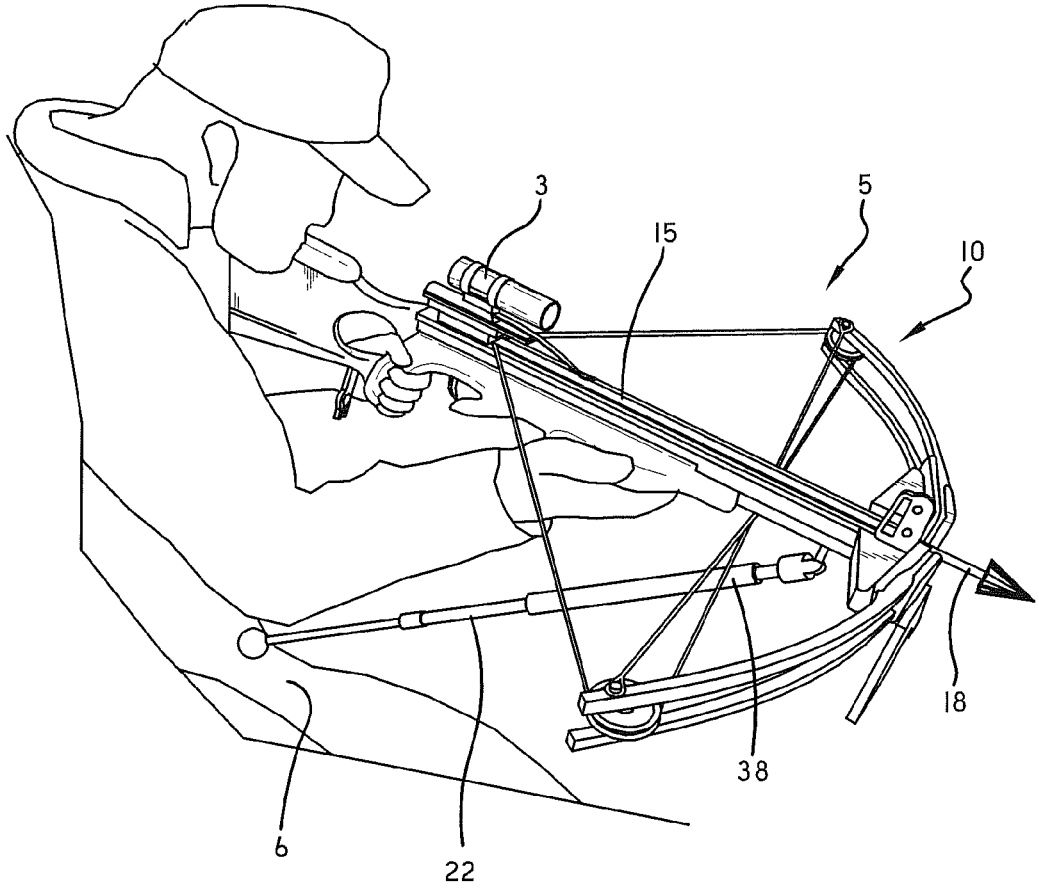
FIG. 3 illustrates the placement of the support rod against a user's body.
Figure 4:
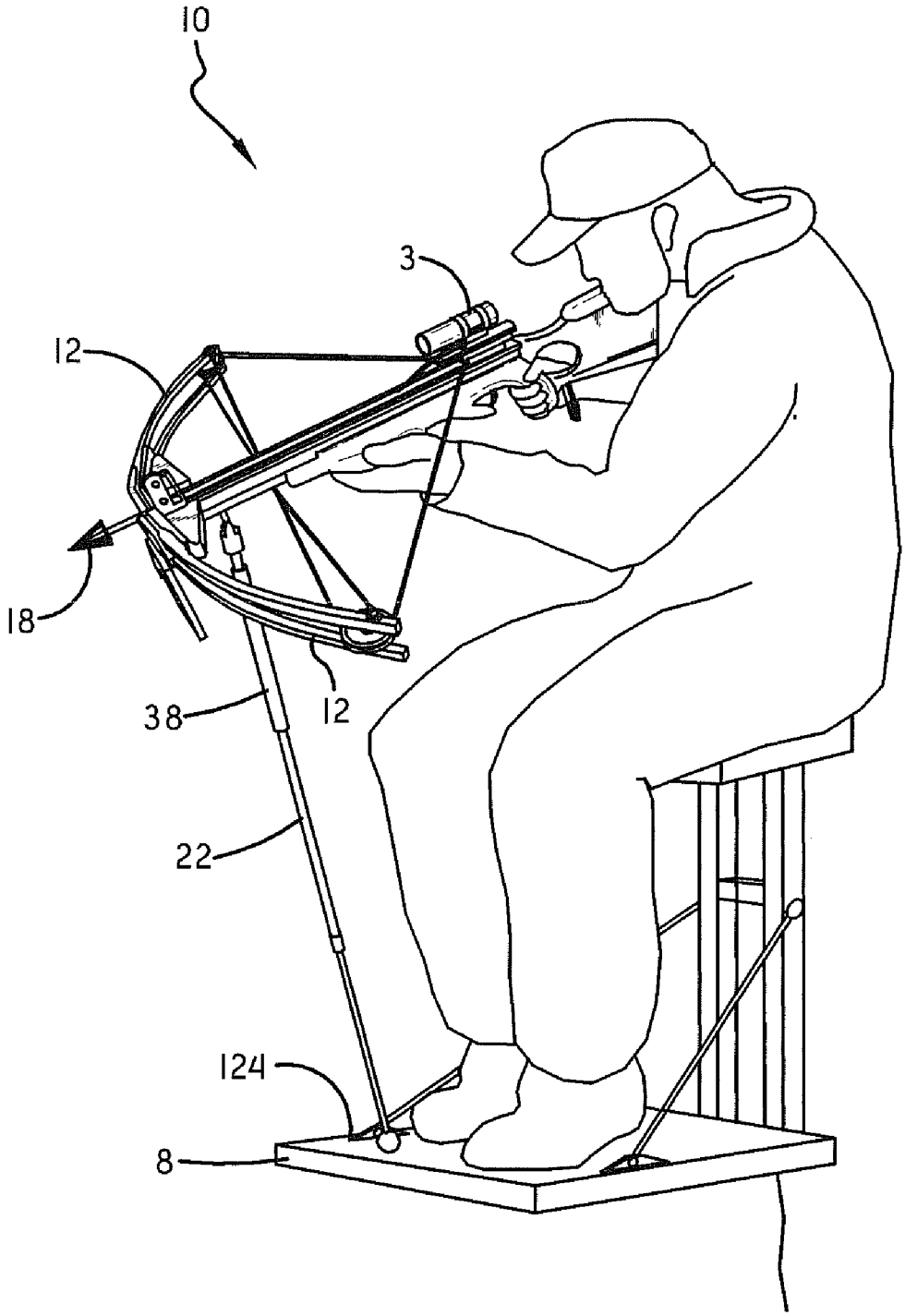
FIG. 4 illustrates the placement of the support rod against a tree stand.

With continuing reference to FIGS. 1 and 2, the support rod 22 has first and second ends 25, 27 and is selectively positionable into a first use position, shown in dashed lines, and a second stowed position, shown in solid lines. Other examples of the first use position are shown in FIGS. 3 and 4. In FIG. 3 the second end 27 of the support rod 22 is supported against the user's body 6 and in FIG. 4 the second end 27 of the support rod 22 is supported against a tree stand 8. In another embodiment the second stowed position is accomplished by completely separating the support rod 22 from the weapon 5. This will be discussed further below.

With reference now to FIGS. 1-2 and 5-6, the support rod 22 used with this invention can be any type chosen with sound engineering judgment. In one embodiment, shown, the support rod 22 is a telescoping two section monopod made by Stoney Point Products, Inc., of New Ulm, Minnesota under the trademark Posi-Lock System™ and made according to U.S. Pat. No. 6,027,087 titled RELEASABLY RETAINING TELESCOPING TUBING SEGMENTS (the '087 patent) which patent is incorporated herein by reference. The support rod 22 may be telescopic with an outer cylindrical pole member 40 and an inner cylindrical pole member 42 assembled to slide within and relative to the pole member 40. The pole members 40, 42 may be locked into relative position as described in the '087 patent though other locking methods chosen with sound engineering judgment may also be used. In this way, the overall length of the support rod 22 can be adjusted according to the user's need. In another embodiment, the length of the support rod 22 can be extended beyond the length of pole members 40, 42 by the addition of a third pole member 48 show in FIG. 6. The use of a third pole member is especially useful when the user wants to maintain a standing position while waiting for game. The third pole member 48 can be added according to the '087 patent or according to other methods chosen with sound engineering judgment. While the support rod 22 shown is used as a monopod, it should be understood that the support rod 22 of this invention would also work with other weapon support mechanisms including bipod and tripod devices. In another embodiment, the support rod 22 may be used as a walking stick when detached from the weapon 5.

Figure 5:
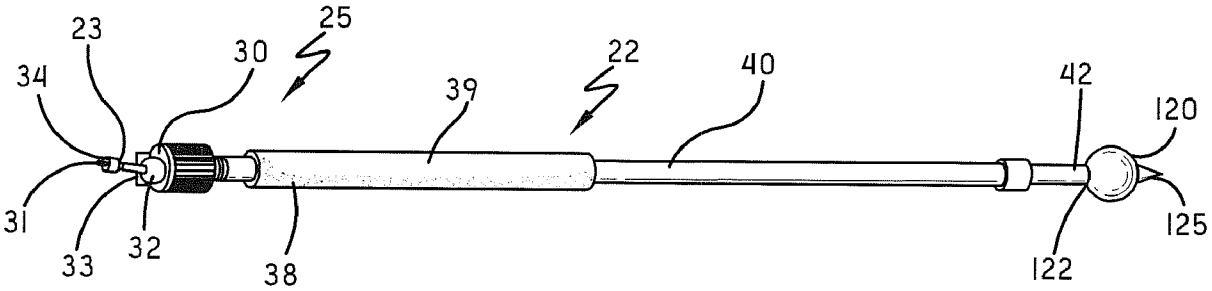
FIG. 5 is an enlarged view of the support rod equipped with a ball joint mount.

With reference now to FIGS. 1-2, and 5, the first end 25 of the support rod 22 is adapted to support the first portion 17 of the main beam 15. In one embodiment, shown for example in FIG. 1, the first end 25 of the support rod 22 is pivotally attached to the main beam 15. This pivotal attachment may be accomplished with a ball joint mount 23 having a first end 31 operatively connected to the main beam 15 and a second end 33 operatively connected to the first end 25 of the support rod 22. In one specific embodiment, the first end 31 may comprise a shaft 34 that is fixedly received in the main beam 15 and the second end 33 may comprise a spherical portion 32 that is rotatably received in a socket 30 formed at the first end first end 25 of the support rod 22. This arrangement permits the main beam 15 of the weapon 5 to be easily moved by rotation; barrel member 14 aimed upward, barrel member 14 aimed downward and barrel member 14 aimed side to side, as desired. In a more specific embodiment, the shaft 34 of the ball joint mount 23 may have threads that are received in the threads formed in the main beam 15 that are exposed when a sling swivel stud 2 attached to the first portion 17 of the main beam 15 is removed.

Figure 7:
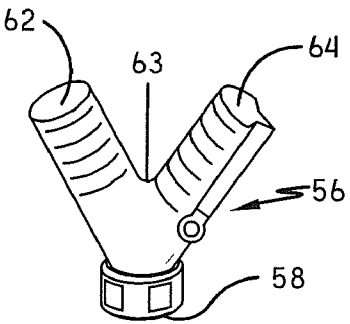
FIG. 7 is a perspective view of a V-shaped support member that may be used to support a weapon.
Figure 8A:
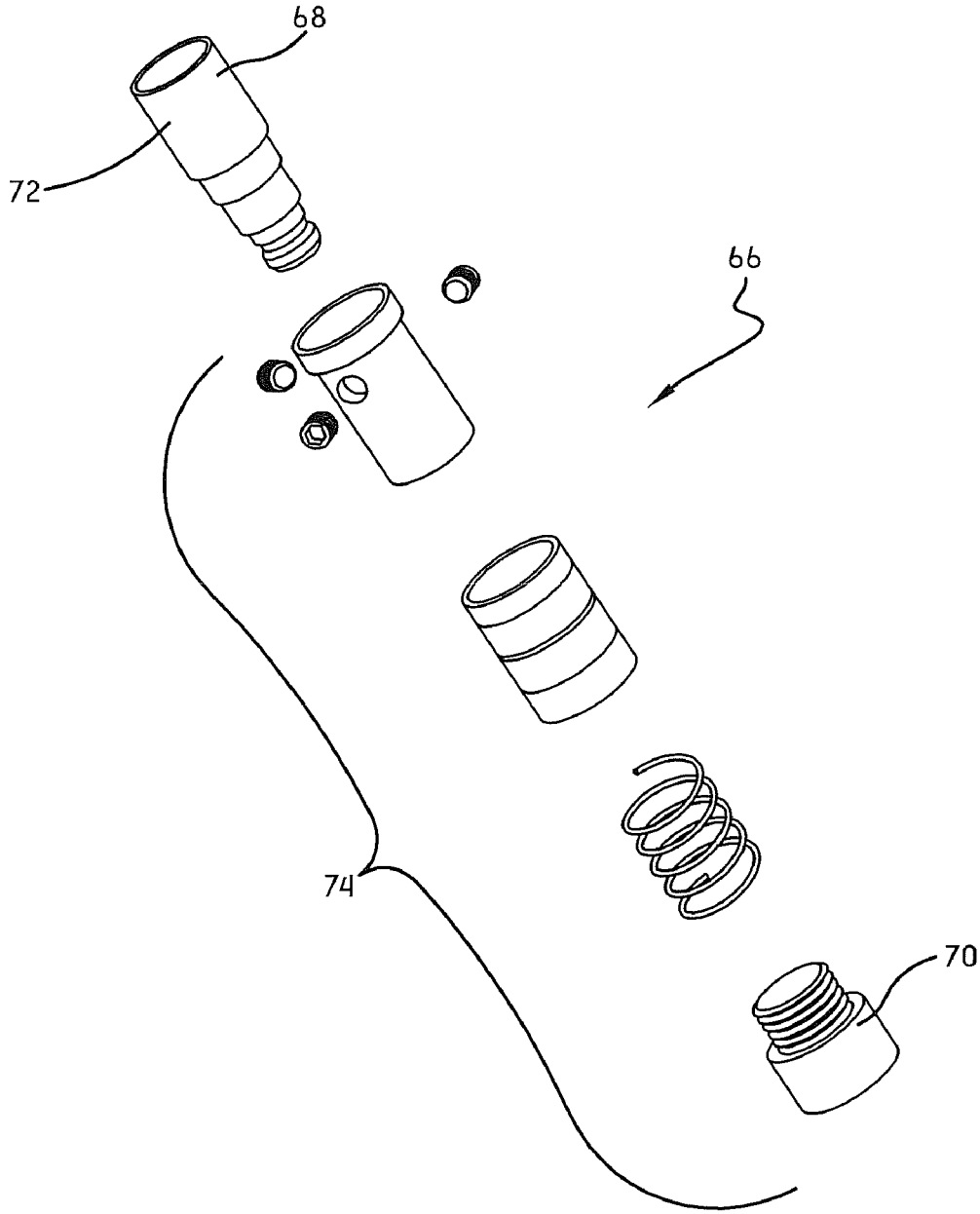
FIG. 8A is an assembly drawing of the quick attach member shown in FIG. 8.
Figure 9:
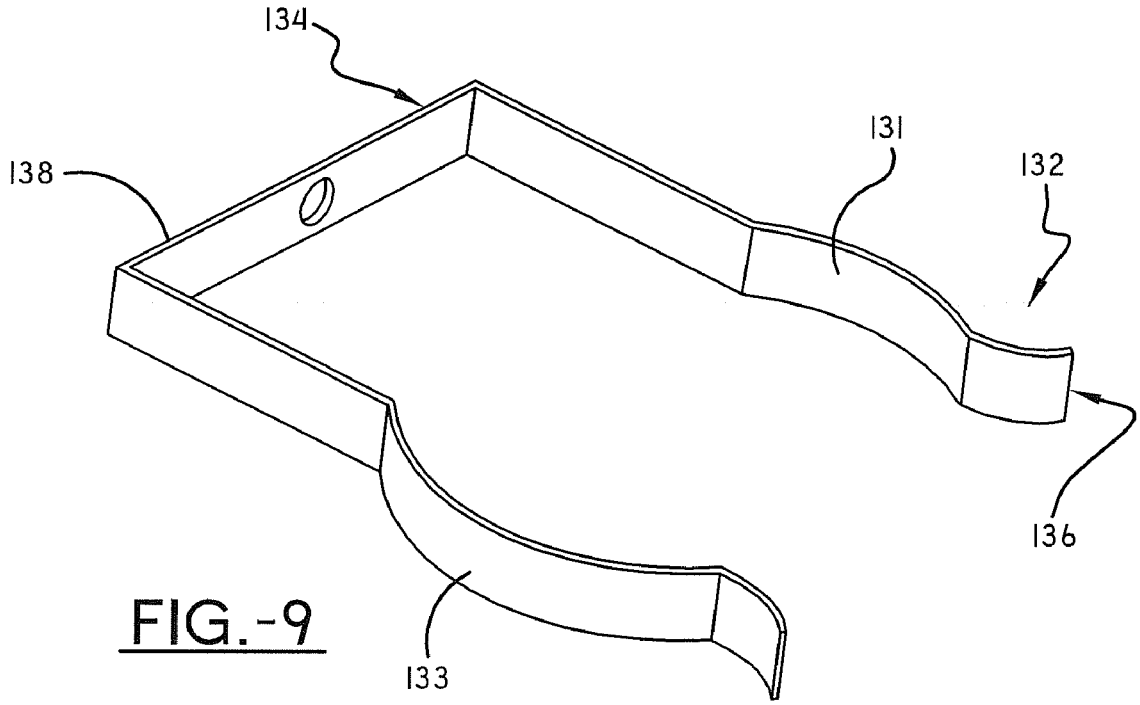
FIG. 9 is a perspective view of a clip that may be used to secure the support rod in the stowed position.

With reference now to FIGS. 1-2, 5 and 7, 8 and 8A, in another embodiment shown in FIG. 7, a V-shaped support member 56 is attached to the first end 25 of the support rod 22. The support member 56 may have a pair of arms 62, 64 defining a support surface 63 that supports the weapon 5. The support member 56 may also have a cylindrical base 58 that attaches to the support rod 22 with threads that are received with corresponding threads on the first end 25 of the support rod 22. In one embodiment, the support member 56 is interchangeable with the ball joint mount 23 providing flexibility. In still another embodiment shown in FIGS. 8 and 8A, a quick attach member 66 may be used to provide a very quick method of attaching and detaching the support rod 22. In one embodiment the quick attach member 66 can be installed between the ball joint mount 23 and the first end 25 of the support rod. The particular design of the quick attach member 66 can be any chosen with sound engineering judgment. For the embodiment shown, however, the quick attach member 66 has a first end 68 that attaches to the second end 33 of the ball joint mount 23 and a second end 70 which attaches to the first end 25 of the support rod 22. The quick attach member 66 may comprise a plug 72 and a socket 74. FIG. 8A shows an assembly drawing of how the plug 72 and socket 74 may be designed. As the operation of a quick attach member 66 is known in the art a detailed description will not be provided here.

Figure 10:
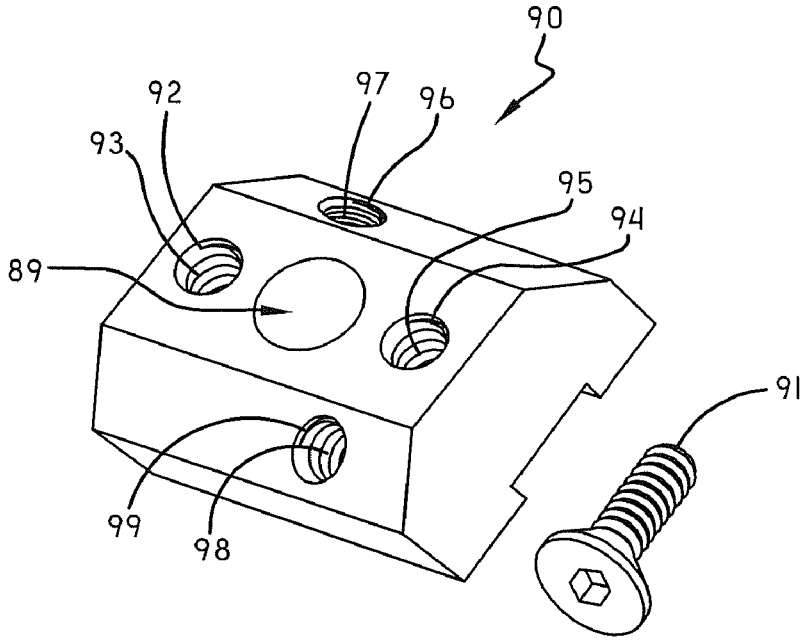
FIG. 10 is a perspective view of a mounting bracket that may be used to provide at least two locations for attaching the support rod to the weapon.

With reference now to FIGS. 1-2, 5 and 10, in another embodiment, a mounting bracket 90 may be attached to the first portion 17 of the main beam 15. The mounting bracket 90 may be attached in any known manner. In one embodiment, the mounting bracket 90 is attached to the main beam 15 by use of a screw 91 received in opening 89 having threads that are received in the threads formed in the main beam 15 that are exposed when a sling swivel stud 2 is removed. In one embodiment, the mounting bracket has a first connection location 92 that connects to some portion of the support rod 22 or a device connected to the support rod 22. The first connection location 92 may, for example, have an opening 93 that receives the shaft 34 of the ball joint mount 23. In another embodiment, the mounting bracket 90 has a second connection location 94 also for use in connecting the support rod 22 to the weapon 5. The second connection location 94 may have an opening 95 of the same size as the opening 93. In this case, the user has two locations to choose from as to where to connect the support rod 22. Additional connection locations could also be provided to supply additional options for the user. In another embodiment, the second opening 95 may have a substantially different size (depth and/or diameter and/or shape, etc.) from the first opening 93. Different diameters are shown in FIG. 10. In this case, the user can use one of two different sized shafts 34; one for the first opening 93, and another for the second opening 95.

With continuing reference to FIGS. 1-2, 5 and 10, in another embodiment, the mounting bracket 90 may have a third connection location 96 with an opening 97 adapted to receive the sling swivel stud 2. This is especially useful if the sling swivel stud 2 was removed in order to attach the mounting bracket 90 to the main beam 15. In still another embodiment, the mounting bracket 90 may have a fourth connection location 98 with an opening 99 also adapted to receive the sling swivel stud 2. In this case, the user has two locations to choose from as to where to connect the sling swivel stud 2. In another embodiment, the third and fourth connection locations 96, 98 may be located on opposite sides of the mounting bracket 90 at an angle, as shown. In this case, the sling swivel stud 2 would extend at least partially to one side of the main beam 15 if it is positioned at the third connection location 96 and at least partially to the opposite side of the main beam 15 if it is positioned at the fourth connection location 98.

Figure 6:
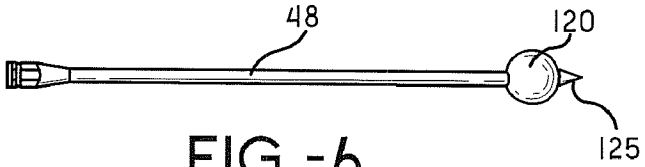
FIG. 6 is an enlarged view of a third pole member that may be used to extend the length of the support rod.
Figure 8:
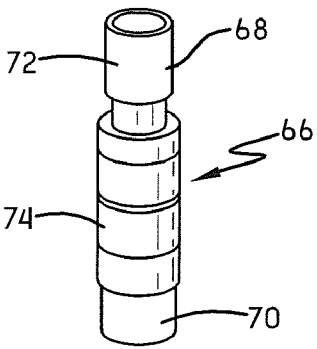
FIG. 8 is a perspective view of a quick attach member that may be used to provide a very quick method of attaching and detaching the support rod.

With reference now to FIGS. 1-6, a contact member 120 may be attached to the second end 27 of the support rod 22. In one embodiment, the contact member 120 has a hemispherical contact surface 122. This hemispherical contact surface 122 serves two important functions. First, it cushions the support rod 22 against a user's body when the support rod 22 is in the first use position shown in FIG. 3. The other function provided by the hemispherical contact surface 122 is that it grips a ground surface 124 when the support rod 22 is in the first use position shown in FIGS. 1 and 4. In another embodiment, the contact member 120 is formed substantially of an elastomeric material. This provides a soft surface for supporting the support rod 22 against the midsection of a user's body and good traction for gripping the ground surface 124. In another embodiment, the hemispherical contact surface 122 is provided using a spherical contact member 120, as shown. The spherical contact member 120, in one embodiment, is formed substantially of a rubber ball. In yet another embodiment, the contact member 120 is selectively removable from the support rod 22. This is especially useful when the support rod 22 is being converted from a two pole design to a three pole design, as discussed above. In this case, the contact member 120 is removed from the end of the two pole design and then attached to the end of the third pole after it has been attached to the second pole as shown in FIG. 6. Optionally, at least one spike member 125 may be attached to and extend from the contact surface 122. One or more spike members 125 improve the grip of the contact surface 122 when the ground surface 124 is covered by rocks, snow or ice. The spike member 125 may, in one embodiment, be formed substantially of carbide.

With reference now to FIGS. 1-2 and 5, in another embodiment the support rod 22 has a handgrip portion 39 adapted to receive a user's hand in supporting the weapon 5 when shooting the weapon 5 when the support rod 22 is in the second stowed position. To add comfort and additional gripability for the user, a resilient material 38 may be applied to the outer surface of the handgrip portion 39, as shown. The resilient material 38 can be any material chosen with sound engineering judgment. In one embodiment, the resilient material 38 is foam rubber.

With reference now to FIGS. 1-2, 5 and 9, as noted above the support rod 22 is selectively positionable into a first use position and a second stowed position. In one embodiment a securing mechanism 130 can be used to selectively secure the support rod 22 to the main beam 15 when the support rod 22 is in the second stowed position. The securing mechanism 130 may include a clip 132 having a first end 134 attached to the main beam 15 and a second end 136 that releasably receives the second end 27 of the support rod 22. The clip 132, in one embodiment shown, may be substantially U-shaped having a mid-section 138 and a pair of legs 131, 133. The mid-section 138 may be attached to the main beam 15 in any manner chosen with sound engineering judgment. In one embodiment, the mid-section 138 may receive a segment 139 of the main beam 15, as shown. One convenient location for attaching the clip 22, where applicable, is just below the opening 140 formed in the stock member 16 behind the trigger mechanism 21. The legs 131, 133 may be "spring-like," (resiliently deformable, in other words) so that they hold the support rod 22 in the stowed position as long as desired but they also fairly easily release the support rod 22 when a user pulls the support rod 22 away from the main beam 15.

Various embodiments have been described, hereinabove. It will be apparent to those skilled in the art that the above methods and apparatuses may incorporate changes and modifications without departing from the general scope of this invention. It is intended to include all such modifications and alterations in so far as they come within the scope of the appended claims or the equivalents thereof.

I claim:

1. A weapon comprising:

a main beam having a first portion and a second portion;

a trigger mechanism mounted to the second portion of the main beam;

a mounting bracket attached to the first portion of the main beam and having first and second connection locations;

a support rod that is selectively positionable into a first use position and a second stowed position, the support rod comprising:

(a) a first end adapted to support the first portion of the main beam at either the first or second connection locations; and, (b) a second end having a contact surface adapted to contact a ground surface when the support rod is in the first use position, wherein the mounting bracket has third and fourth connection locations, a sling swivel stud that is selectively positionable at either the third or fourth connection locations, wherein the sling swivel stud extends at least partially to the side of the main beam when the sling swivel stud is positioned at the third connection location.

2. The weapon of claim 1, wherein the sling swivel stud extends at least partially to the opposite side of the main beam when the sling swivel stud is positioned at the fourth connection location.

3. A weapon comprising:

a main beam having a first portion and a second portion;

a trigger mechanism mounted to the second portion of the main beam;

a mounting bracket attached to the first portion of the main beam and having first and second connection locations;

a support rod that is selectively positionable into a first use position and a second stowed position, the support rod comprising:

(a) a first end adapted to support the first portion of the main beam at either the first or second connection locations; and, (b) a second end having a contact surface adapted to contact a ground surface when the support rod is in the first use position, wherein the first and second connection locations comprise first and second openings, respectively, the first and second openings having substantially different sizes.

* * * * *